US006766970B2

(12) United States Patent
Pecora

(10) Patent No.: US 6,766,970 B2
(45) Date of Patent: Jul. 27, 2004

(54) METHOD AND APPARATUS FOR A CRUSHER

(76) Inventor: Anthony J. Pecora, HCR 2, Box 889, Tucson, AZ (US) 85735-9754

( * ) Notice: Subject to any disclaimer, the term of this patent is extended or adjusted under 35 U.S.C. 154(b) by 125 days.

(21) Appl. No.: 10/006,788

(22) Filed: Dec. 6, 2001

(65) Prior Publication Data

US 2002/0100824 A1 Aug. 1, 2002

Related U.S. Application Data

(60) Provisional application No. 60/251,677, filed on Dec. 6, 2000.

(51) Int. Cl.[7] ..... B02C 23/18

(52) U.S. Cl. ..... 241/23; 241/65; 241/74; 241/29; 241/152.2; 241/DIG. 37

(58) Field of Search ..... 241/23, 65, 74, 241/24.1, 29, 152.2, DIG. 37, 69, 73, 26

(56) References Cited

U.S. PATENT DOCUMENTS

| | | | | |
|---|---|---|---|---|
| 3,960,329 A | | 6/1976 | Aagaard | |
| 3,977,132 A | | 8/1976 | Sekigawa | |
| 4,193,554 A | | 3/1980 | Ansen et al. | |
| 4,273,294 A | * | 6/1981 | Hollely et al. | 241/18 |
| 4,304,798 A | | 12/1981 | Clapp et al. | |
| 4,428,535 A | * | 1/1984 | Venetucci | 241/35 |
| 4,738,194 A | | 4/1988 | Ando et al. | |
| 4,790,906 A | | 12/1988 | Coffey et al. | |
| 5,203,511 A | * | 4/1993 | Ondush et al. | 241/5 |
| 5,524,838 A | * | 6/1996 | Ellers et al. | 241/23 |
| 5,683,040 A | * | 11/1997 | Jakob et al. | 241/14 |
| 6,100,305 A | | 8/2000 | Miyake et al. | |

OTHER PUBLICATIONS

Pennsylvania Crusher Corp., "Solving Your ProblemsHandbook of Crushing/Mechanical Reduction Methods," *at* http://www.penncrusher.com/1sol1_2.html, 1sol_5.html, 1sol_6.html (last visited Jun. 14, 2002).

Pennsylvania Crusher Corp., "Solving Your ProblemsHandbook of Crushing/Crusher Selection," *at* http://www.penncrusher.com/1sol1_3.html (last visited Jun. 14, 2002).

Pennsylvania Crusher Corp., "Solving Your ProblemsHandbook of Crushing/Power Requirements," *at* http://www.penncrusher.com/1sol1_4.html (last visited Jun. 14, 2002).

Pennsylvania Crusher Corp., "Solving Your ProblemsHandbook of Crushing/Hammer Technology," *at* http://www.penncrusher.com/1sol1_5.html (last visited Jun. 14, 2002).

Pennsylvania Crusher Corp., "Solving Your ProblemsHandbook of Crushing/Glossary of Terms," *at* http://www.penncrusher.com/1sol1_6.html (last visited Jun. 14, 2002).

* cited by examiner

*Primary Examiner*—Mark Rosenbaum
(74) *Attorney, Agent, or Firm*—Webb Ziesenheim Logsdon Orkin & Hanson, P.C.

(57) ABSTRACT

An apparatus that pulverizes feedstock material with crushers injects a liquefied inert gas into the feedstock material, evaporation of the gas causing the material to become very cold, brittle, facilitating further processing. Very fine finished particle sizes, passing −200 micron mesh screens, result from the use of the apparatus. The apparatus generally requires little maintenance to achieve such small particle size as compared to mechanical crushers. Because of the effect of the inert gas upon the feedstock material, pulverization generally occurs by impact only. A method for pulverizing is also described.

11 Claims, 2 Drawing Sheets

METHOD AND APPARATUS FOR A CRUSHER

CROSS REFERENCE TO RELATED APPLICATION

This application claims the benefit of U.S. Provisional Patent Application No. 60/251,677 filed Dec. 6, 2000.

BACKGROUND OF THE INVENTION

1. Field of the Invention

This invention relates to pulverizing and, more particularly, the use of an inert gas, such as carbon dioxide or nitrogen, to cool a feedstock of material, which is then pulverized.

2. Description of the Prior Art

Equipment which processes material by reducing its size and increasing its surface area is widely known in the art. Generally, various types of mechanical reduction methods are applied to materials to reduce the size of the material and increase its surface area as a function of weight or unit volume. There are four basic ways to reduce material: by impact, attrition, shear or compression. Apparatus known in the art employ one or a combination of these four methods to process material for subsequent use. Materials can be processed by impacting in one of two ways: by gravity impact or by dynamic impact. In gravity impact, the material is dropped onto a surface harder than the material being processed. This method is most often used to separate two materials which have different friability. The more friable material is broken while the balance remains intact. The friable material can then be separated from the remainder by screening. Gravity impact is frequently employed in the processing of coal by dropping it onto a hardened steel plate.

Dynamic impact typically involves a rotary hammer that accelerates the feedstock material towards breaker blocks or other hammers. Dynamic impact is used when a well-graded cubicle particle is the desired result of processing, to break ores along cleavage lines removing inclusions, and for materials too hard or abrasive for hammermills.

The attrition process reduces materials by subjecting them to forces between two hard surfaces. Typically, the material is first processed by the impact method using hammers and then further reduced by attrition of the material against screen bars. The process is appropriate for materials that are abrasive, such as limestone and coal.

In comparison, shear processing involves a trimming or cleaving action, as opposed to the rubbing action that occurs during attrition. Shear material processing is typically used during primary crushing when the desired reduction ratio is in the range of 6:1.

Compression processing is achieved by crushing material between two surfaces, one or both surfaces acting on the material being processed. Compression processing is used on extremely hard, tough, abrasive rock that breaks cubically. Compression material processing can be combined with attrition processing.

One or more of the crushing methods described above is used to process raw feedstock material into sizes more suitable for end use. Often, the methods are employed in series, each step reducing the size and increasing the surface area of the material being processed. For example, precious and semi-precious metal ores, like gold, silver and copper, are reduced in size and the surface area increased to facilitate the further refining of the ore into a finished product. Coal may be processed in a similar manner for use as a fuel source particularly in fluidized bed reactors or boilers. Generally, the combustion efficiency of a fluidized bed boiler using processed coal increases in proportion to the surface area of the coal fuel source. A third example of a finely processed material would be Portland cement, wherein finer particle sizes result in a stronger, more dense finished concrete composite product.

Processing material into finer and finer particulate sizes requires increasing energy consumption. Such processing also accelerates the wear on the equipment being used, particularly when the finished product is "pulverized" for passing a −200 micron screen. The preprocessing of material feedstocks to facilitate a pulverized finished product, apart from using mechanical means, is unknown in the art.

SUMMARY OF THE INVENTION

An apparatus is provided for using a source of inert gas to significantly reduce the temperature of a feedstock material, increase its brittleness, and render the feedstock more susceptible to further processing, preferably pulverization. A method of using the apparatus is also described. The apparatus has a feedstock hopper which, by its dimension, controls the rate of material entering the apparatus. The feedstock is then exposed to a source of liquefied inert gas. As the feedstock material travels through the inlet, the liquefied inert gas expands and absorbs a tremendous amount of heat energy. The heat necessary to convert the liquefied gas to a gaseous state is absorbed from the feedstock material, cooling it significantly. In this cooled state, the feedstock material is extremely brittle and very little mechanical energy is required to pulverize it. The feedstock material then travels from the inlet into a crusher, such as a flywheel turbine. The blades of the flywheel turbine dynamically impact the feedstock material, reducing the material into powder. The housing of the flywheel turbine is adapted such that processed material is forced through an outlet once it has reached the proper particle size. A screen may be placed over the outlet to ensure uniform gradation of the finished product.

A wide range of materials can be processed using this invention. The pulverizer can be adapted to produce a wide variety of finished products by simply varying the dimensions of the inlet hopper, the inclination of the inlet tube, the rate of flow and type of inert gas used, and the dimensions and configuration of the crusher. Qualities of the finished product can be varied by regulating the flow rate of the inert gas, controlling cooling by using different inert gases, each having its own latent heat of evaporation, regulating the time to which the feedstock is exposed to the inert gas, and by varying the energy imparted by the crusher upon the material following cooling.

DETAILED DESCRIPTION OF THE PREFERRED EMBODIMENT

Figure 1:
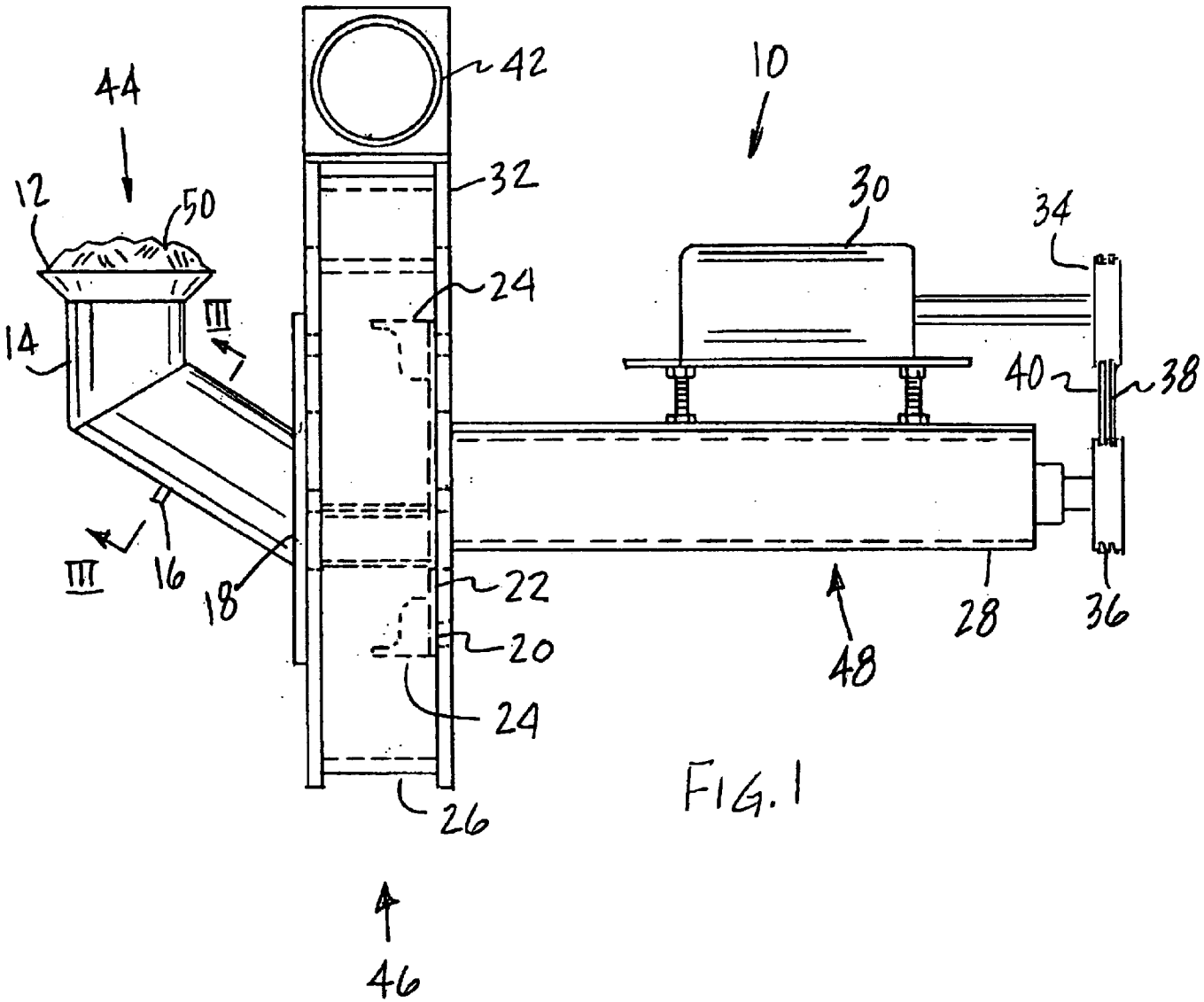
FIG. 1 is an elevation view of an apparatus according to a preferred embodiment of the present invention.

For the purposes of the description hereinafter, the terms "upper", "lower", "right", "left", "vertical", "horizontal", "top", "bottom", and derivatives thereof, shall relate to the invention as it is oriented in the drawing figures. However, it is to be understood that the invention may assume alternative variations and step sequences except where it is expressly specified to the contrary. It is also to be understood that the specific devices in processes illustrated in the attached drawings, and described in the following specification, are simply exemplary embodiments of the invention and specific dimensions and other physical characteristics related to the embodiments disclosed herein are not to be considered as limiting.

FIG. 1 shows an inert gas-aided pulverizer 10. The pulverizer 10 consists of three sections: a material inlet section 44, a pulverizer device 46 and a drive device 48. The material inlet section 44 consists of an inlet hopper 12, an inlet tube 14 and inert gas nozzles 16. The material to be processed is placed into the inlet hopper 12. The physical dimensions of inlet hopper 12 and the initial size of a feedstock material 50 to be processed control the rate of input of feedstock material into the inert gas-aided pulverizer 10. The feedstock material 50 travels from inlet hopper 12 into inlet tube 14. Inlet tube 14 is inclined from the horizontal approximately 30° to control the rate of travel and time that the feedstock material 50 is exposed to the inert gas. The inert gas enters the inlet tube 14 through inert gas nozzles 16. The source of the inert gas is not shown, but may include pressurized tanks of liquefied nitrogen, or a suitable equivalent. The invention will now be further described using liquefied nitrogen as an exemplary source of inert gas.

Figure 3:
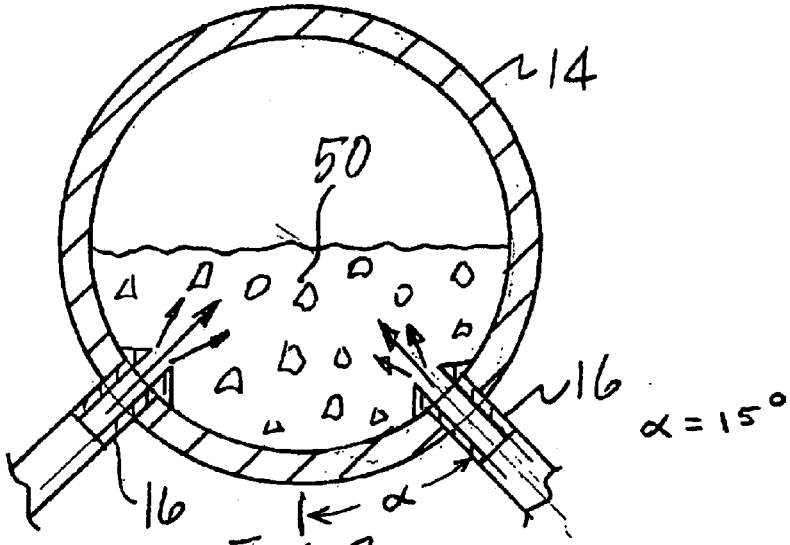
FIG. 3 is a cross-sectional view of the inlet tube and jet shown along line B–B' of the apparatus, of FIG. 1.

FIG. 3 shows a cross section of the inlet tube 14 of the inert gas-aided pulverizer 10, shown in FIG. 1, along line B–B'. Two inert gas nozzles 16 are shown penetrating inlet tube 14. Each inert gas nozzle 16 is approximately 15° from vertical, as viewed in FIG. 3. Inert gas nozzles 16 allow for the flow of liquefied nitrogen from a source, not shown, into inlet tube 14. As the liquefied nitrogen flows from inert gas nozzle 16, it evaporates into a gaseous state, absorbing heat from feedstock material 50 in so doing. The exact degree of cooling of feedstock material 50 is a function of the rate of feedstock material 50 that passes through inlet hopper 12, the degree of inclination of inlet tube 14, the rate of inert gas that flows through inert gas nozzles 16, and the shape of the outlet pattern of that gas as it emerges from inert gas nozzles 16. The temperature of the feedstock material 50 entering housing inlet 18 (as shown in FIG. 1) can be controlled by varying the dimensions of inlet hopper 12, the size of the feedstock material 50, the inclination of inlet tube 14, and the rate of gas flow through inert gas nozzles 16.

Generally, feedstock material 50 is cooled to between approximately −100° C. to −150° C. depending on the rate of gas flow through inert gas nozzles 16 and the initial size of feedstock material 50. For example, copper ore may be pre-processed such that it has an average dimension of ½", whereas coal, a more friable material, may be as large as 1¼" in size before pulverization. The rate of flow of nitrogen, or other inert gas, the adaptation of inert gas nozzles 16, including additional nozzles in more complex arrangements, the manner in which the inert gas nozzles 16 are manifolded to the source of nitrogen, the inclination of inlet tube 14 and the dimensions of inlet hopper 12 can be varied relative to each other during operation to achieve the desired finished product based on empirical results without departing from the spirit and scope of this invention.

Once the feedstock material 50 is cooled by the exposure to the inert gas, it becomes brittle, loses mechanical strength and is rendered susceptible to pulverization by mechanical means. The feedstock material 50 is reduced in size and its surface area increased simply by traveling down inlet tube 41 to housing inlet 18 in its cooled state.

Returning to FIG. 1, the feedstock material 50 enters the pulverizing device 46 through housing inlet 18. During operation, a motor 30 turns a drive shaft 28 by turning a motor pulley 34 connected to a drive shaft pulley 36 via two belts 38 and 40. The drive shaft 28 is mechanically attached to a flywheel turbine 20. The drive shaft 28 turns the flywheel turbine 20 causing turbine blades 24 to rotate in a circular pattern within a housing 32 of pulverizing device 46. As the feedstock material 50 enters the pulverizing device 46, the rotating turbine blades 24 of flywheel turbine 20 impact the feedstock material 50. Because of its extremely cool and brittle state, the impact of the turbine blades 24 on feedstock material 50 pulverizes the feedstock material 50 into a very fine powder capable of passing a −200 micron screen.

Feedstock material 50 is pulverized by pulverizing device 46 almost exclusively by impact. The housing 32 is shaped and sized relative to the flywheel turbine 20 to eliminate the occurrence of attrition and to reduce wear of the parts within the housing 32. Further, by using T1 or carbide steel to manufacture the entire flywheel turbine 20 and a housing lining 26, maintenance on the pulverizer 10, during ordinary operation, is significantly reduced.

Figure 2:
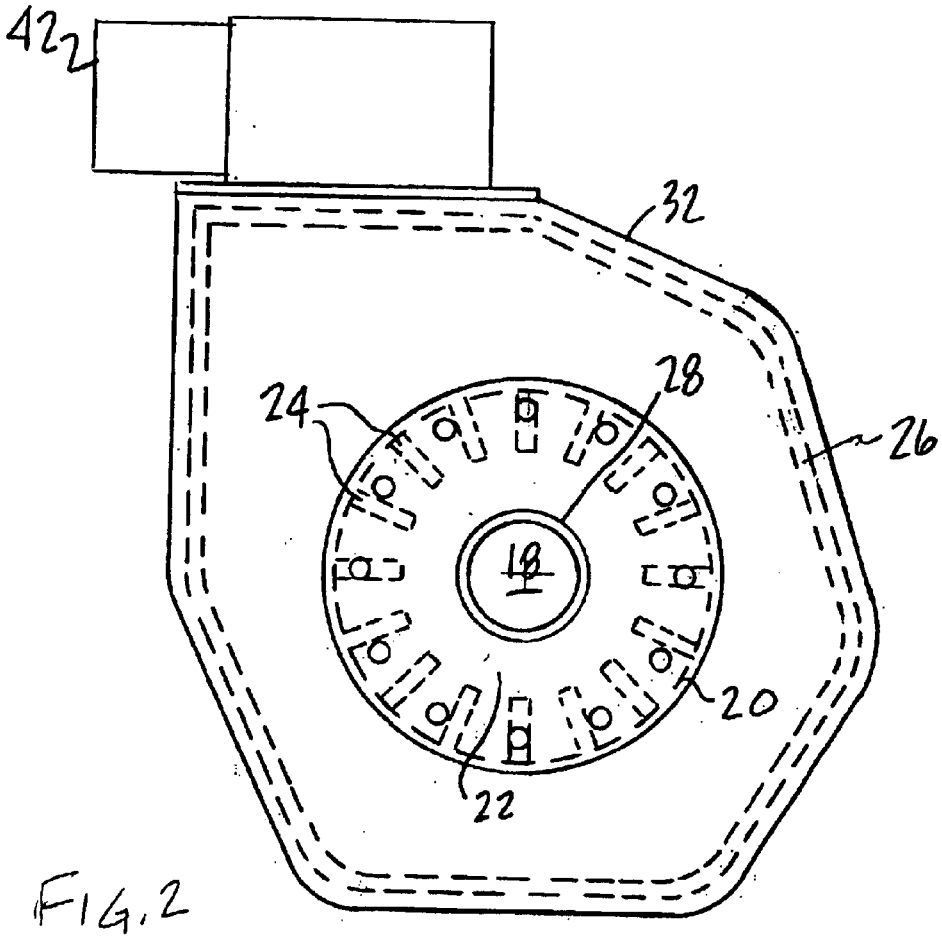
FIG. 2 is a cross-sectional view along line A–A' of the apparatus shown in FIG. 1.

Turning to FIG. 2, the exterior shape of the pulverizing device 46 is shown. Flywheel turbine 20 rotates between 1500 and 3600 revolutions per minute whereby turbine blades 24 impact the feedstock material 50, pulverizing it. The rate of rotation of drive shaft 28 can be varied to control the finished size of the material, its gradation and the ratio of surface area to weight. Generally, the grain size of the finished product is a function of the rate at which flywheel turbine 20 rotates and the number of turbine blades 24 attached to the flywheel turbine 20. Typically, the lower the rate of rotation of flywheel turbine 20, the larger the size of the finished product. Experimentally, with a 3" diameter inlet tube 14, flywheel turbine 20 rotation at 3000, 2750 and 2750 RPMs is appropriate for Portland cement, coal (up to 1¼" feedstock size), and copper ore (up to 1" feedstock size), respectively. As flywheel turbine 20 rotates within this range, a pressure differential results across housing 32 causing feedstock material 50 to enter housing inlet 18 under a vacuum, and be impacted by turbine blades 24. The impact of turbine blades 24 accelerates feedstock material 50 toward housing lining 26. The pressure differential across housing 32 further causes feedstock material 50 to be exited through an outlet tube 42. The pressure differential across housing 32 is the result of the relative shape and dimensions of the exterior of the pulverizing device 46, the flywheel turbine 20, and the position of the outlet tube 42. One skilled in the art would recognize that alternative configurations would result in similar flows of processed material through the pulverizing device.

Once the material has been processed and exits pulverizing device 46 through the outlet tube 42, it can be further separated by mechanical means, including screening and filtering, to tightly control the final finished product. Additionally, outlet tube 42 can be adapted to include a mesh screen so that relatively larger particles are recycled within the pulverizing device 46 until processed to the desired finished size.

Material having the capacity to pass through a −200 micron mesh screen is valuable in a number of situations. There are a number of applications where finer particle size and greater surface area would provide significant benefits. These applications include refining precious and semi-precious metal ores like gold, silver and copper, processing coal for fluidized bed reactors or boilers, and processing Portland cement for specialty construction applications. Each of these different types of materials is currently processed using exclusively mechanical means to reduce the particle size and increase surface area of the materials.

Current processing of precious and semi-precious metal ores uses acid and cyanide baths to prepare the ores for refining. Over the past few years, the environmental and safety regulations of such operations have come under increasing scrutiny. Fine particle sizes can be achieved at efficient rates by utilizing the method and apparatus of the present invention. Metal ores with small particle size and increased surface area can be processed more efficiently because the metal can more easily be extracted from the ores, particularly when using acid and cyanide baths.

Similarly, the use of fluidized bed technology in the coal burning industry has become more prevalent. Fluidized bed boilers burn coal more efficiently and more cleanly than conventional burners. Coal processed through the method and apparatus of the present invention would result in a product having smaller particle size and greater surface area. This product would burn more efficiently, more completely, and result in fewer emissions as compared to coal processed by traditional mechanical crushing methods. Typically, facilities using fluidized bed technology for coal fuel spend significant sums to maintain their ball mill grinders used to process coal for that application. Maintenance costs would be significantly reduced if the apparatus and method of the present invention were used to process feedstock material for the fluidized bed reactor. The invention could be combined downstream in series with a traditional ball mill. With such an arrangement, the finished particle size output from the ball mill could be much greater. Larger particle size reduces attrition within the ball mill and correspondingly reducing the maintenance necessary to address that attrition.

In addition to a flywheel turbine crusher, shown herein, the invention could also be embodied in combination with a rotary hammermill, or with simple gravity feed of the material by dropping onto a hard surface, both preceded by exposure of the feedstock to evaporating inert gas.

There are occasions in the construction industry where dense strong concrete is required. The strength and density of any concrete product is, among others, a function of the gradation of the Portland cement used to make the concrete composite. Portland cement processed with the method and apparatus of the present invention would have a smaller particle size and greater surface area. Accordingly, a denser, stronger, concrete composite material can be made by using material that has been processed in accordance with the present invention. Such a concrete composite would be appropriate for those circumstances where a strong, dense, concrete composite is required. Concrete composites, manufactured from cement subjected to the process of the present invention, result in an approximately 30% increase in the strength and density of the finished composite as this result having been demonstrated by standard testing.

While the preferred embodiment of the present invention has been described, it will be understood that the invention is not limited thereto, but may be otherwise embodied and practiced within the scope of the appended claims and equivalents thereto.

I claim:

1. An apparatus for pulverizing a feed material, comprising:

(a) an inclined gravity feed inlet section configured to control the rate of flow and cooling of the feed material into the apparatus;

(b) a plurality of gas nozzles in communication with a source of liquefied inert gas, said gas nozzles connected to the inlet section and directed radially inward thereto such that the material traveling through the inlet section is exposed to the inert gas as it evaporates, causing the feed material to be cooled and facilitating mechanical pulverization of the feed material;

(c) a crusher directly connected to the inlet section, downstream of the gas nozzles, the crusher having a rotating part and a lining part configured such that the rotating part impacts the material during operation of the device and accelerates the material towards the lining part, the operation thereof pulverizing the material into a smaller size; and (d) an outlet section connected to the crusher configured to control the rate of flow of the material exiting the device.

2. The apparatus of claim 1, wherein the crusher is comprised of a surface which is harder than the feed material.

3. The apparatus of claim 1, wherein the crusher is a flywheel turbine.

4. The apparatus of claim 1, wherein the inlet section is inclined to about 30° from horizontal.

5. The apparatus of claim 1, wherein the liquefied inert gas is at least one of carbon dioxide and nitrogen.

6. The apparatus of claim 1, wherein there are two nozzles directed radially into the inlet section, each nozzle fixed 15° from vertical when viewed in cross-section.

7. The apparatus of claim 1, wherein the outlet section includes a mesh screen that limits the size of the feed material exiting the crusher.

8. A method for pulverizing coal comprising:

(a) placing the coal into an inclined inlet and feeding the coal through the inlet solely by gravity;

(b) introducing a liquefied inert gas radially into the inlet via at least two as nozzles, directed upwardly and inwardly to the inlet at an angular orientation;

(c) evaporating the liquefied inert as in the presence of the coal so that the coal is cooled and becomes more susceptible to mechanical pulverization;

(d) pulverizing the cooled material, by impacting it with a flywheel turbine;

(e) passing, by means of pressure differential, the pulverized coal to an outlet tube; and, (f) recycling, by means of a mesh screen on the outlet tube, larger particles for further pulverization.

9. The method of claim 8, wherein the feed material is pre-crushed prior to step (a).

10. The method of claim 8, wherein the feed material is cooled to at least −100° C. prior to the pulverization step.

11. The method of claim 8, wherein the liquefied inert gas is at least one of carbon dioxide and nitrogen.

* * * * *

UNITED STATES PATENT AND TRADEMARK OFFICE

CERTIFICATE OF CORRECTION

PATENT NO. : 6,766,970 B2
DATED : July 27, 2004
INVENTOR(S) : Pecora

It is certified that error appears in the above-identified patent and that said Letters Patent is hereby corrected as shown below:

Column 6,
Line 43, “two as nozzles” should read -- two gas nozzles --
Line 45, “liquefied inert as” should read -- liquefied inert gas --

Signed and Sealed this

Fifteenth Day of February, 2005

JON W. DUDAS
*Director of the United States Patent and Trademark Office*